US007919041B2

(12) United States Patent
Joo

(10) Patent No.: US 7,919,041 B2
(45) Date of Patent: Apr. 5, 2011

(54) HEARTH ROLL APPARATUS FOR ANNEALING FURNACE

(75) Inventor: Ji-Yong Joo, Pohang (KR)

(73) Assignee: POSCO, Pohang (KR)

( * ) Notice: Subject to any disclaimer, the term of this patent is extended or adjusted under 35 U.S.C. 154(b) by 434 days.

(21) Appl. No.: 12/066,336

(22) PCT Filed: May 10, 2006

(86) PCT No.: PCT/KR2006/001740
§ 371 (c)(1),
(2), (4) Date: Mar. 10, 2008

(87) PCT Pub. No.: WO2007/032589
PCT Pub. Date: Mar. 22, 2007

(65) Prior Publication Data

US 2008/0296813 A1 Dec. 4, 2008

(30) Foreign Application Priority Data

Sep. 13, 2005 (KR) ..... 10-2005-0085174
Mar. 21, 2006 (KR) ..... 10-2006-0025740

(51) Int. Cl.
*C21D 1/00* (2006.01)
*B22D 11/00* (2006.01)

(52) U.S. Cl. ..... 266/274; 266/249; 266/276; 266/103; 432/121; 432/246

(58) Field of Classification Search ..... 266/103, 266/249, 274, 276; 432/121, 246
See application file for complete search history.

(56) References Cited

FOREIGN PATENT DOCUMENTS

| | | | |
|---|---|---|---|
| JP | 64-055325 | * | 2/1989 |
| JP | 1139716 A | | 6/1989 |
| JP | 1147017 A | | 6/1989 |
| JP | 8295948 A | | 11/1996 |
| KR | 20030054539 A | | 7/2003 |
| KR | 2005-0080640 | * | 8/2005 |

* cited by examiner

*Primary Examiner* — Roy King
*Assistant Examiner* — Lois Zheng
(74) *Attorney, Agent, or Firm* — The Webb Law Firm

(57) ABSTRACT

A hearth roll apparatus for feeding a strip sheet in an annealing furnace is disclosed. The hearth roll apparatus includes a ceramic tube which is provided inside the annealing furnace to contactingly feed a strip sheet, a roll shaft which is coupled to a first end of the ceramic tube and extends across the annealing furnace through the ceramic tube, a tube fixing sleeve which is coupled to a second end of the ceramic tube and through which a portion of the roll shaft is inserted, and a tension generating unit which interlocks with the roll shaft and the tube fixing sleeve and supplies a tensile force for stretching the roll shaft in a longitudinal direction. Accordingly, thermal deformation like creep buy which the roll shaft is bent down is minimized, and a line speed of the strip sheet can be increased by high-speed rotation of the hearth roll.

14 Claims, 14 Drawing Sheets

[Fig. 1]
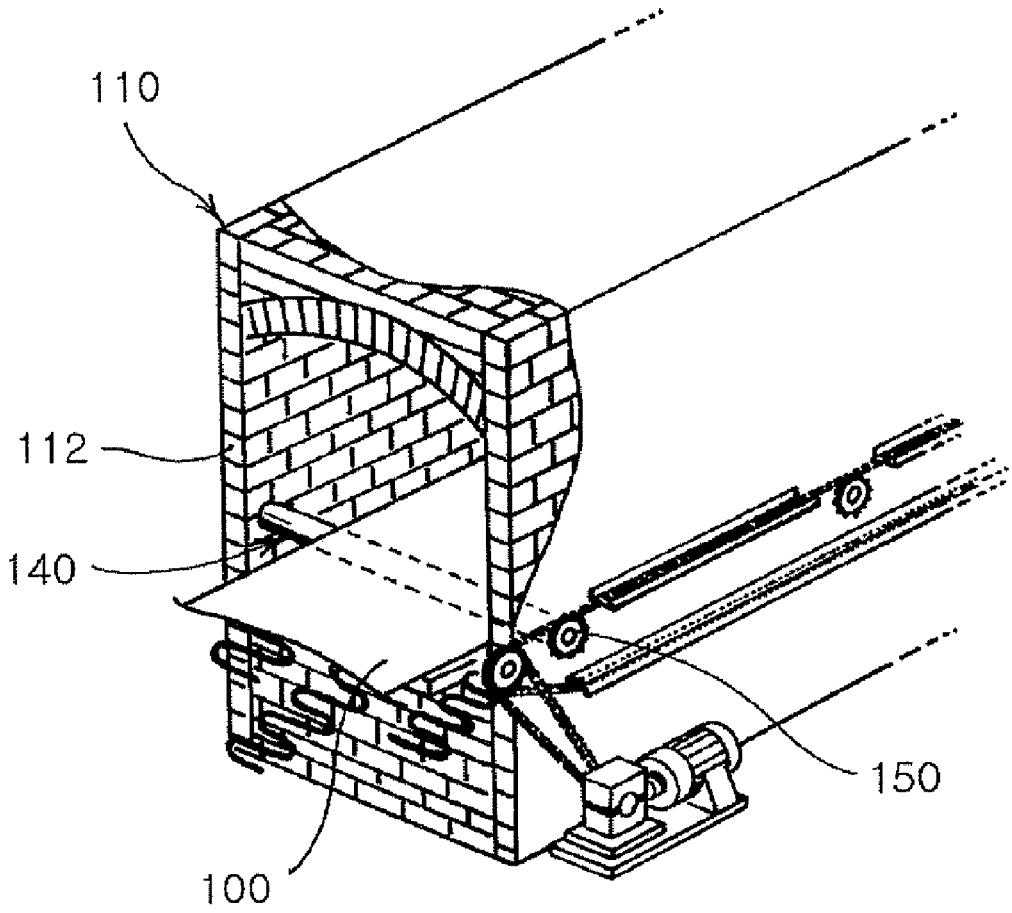
Prior Art

[Fig. 2]
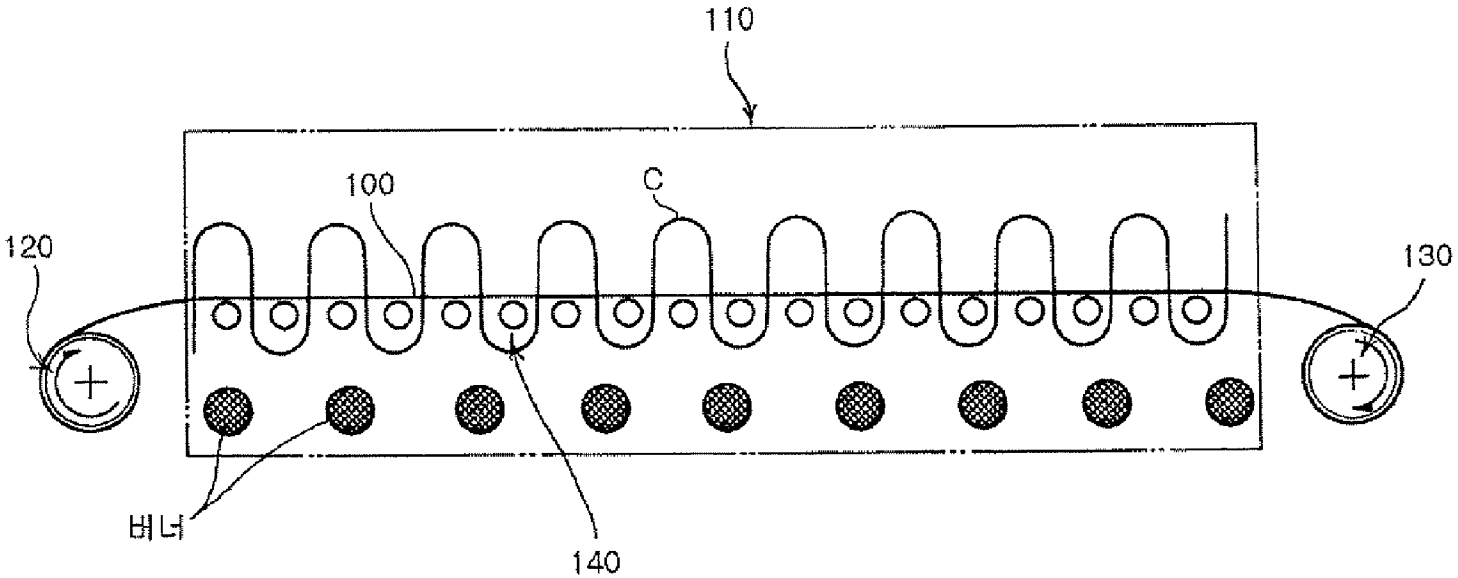
Prior Art

[Fig. 3]
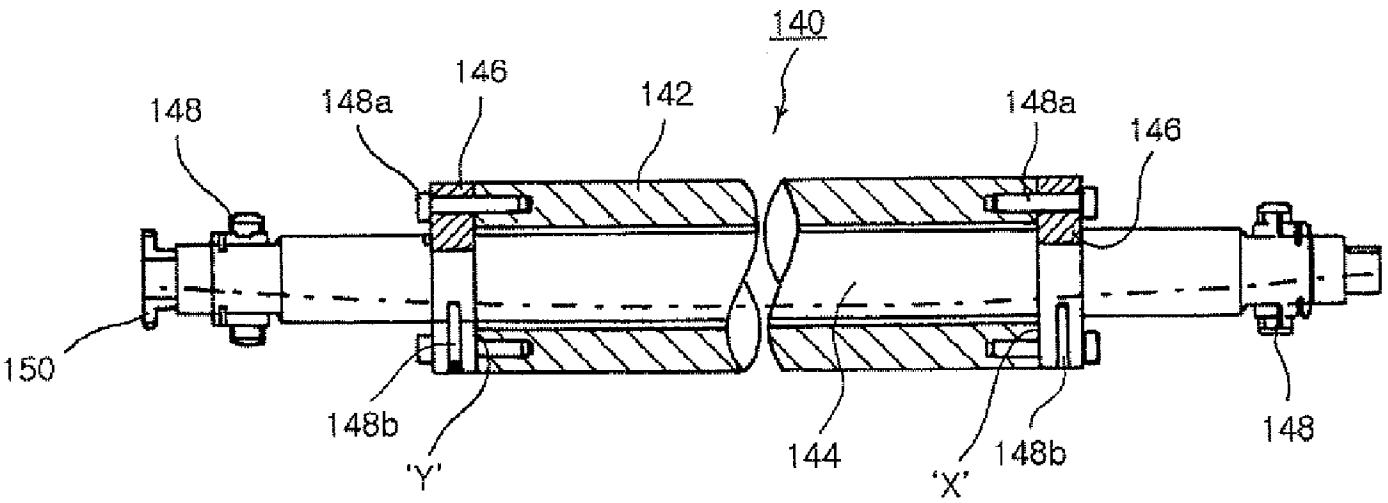
Prior Art

[Fig. 4]
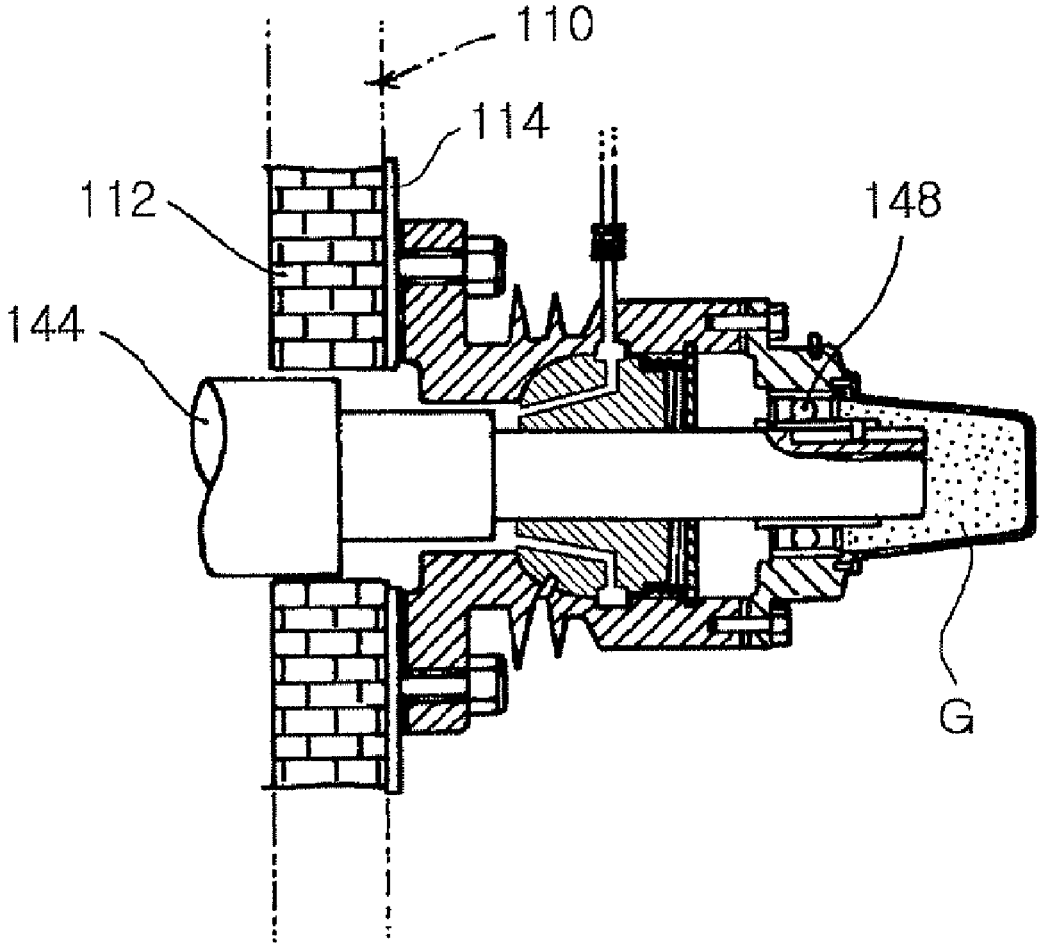
Prior Art

[Fig. 5]
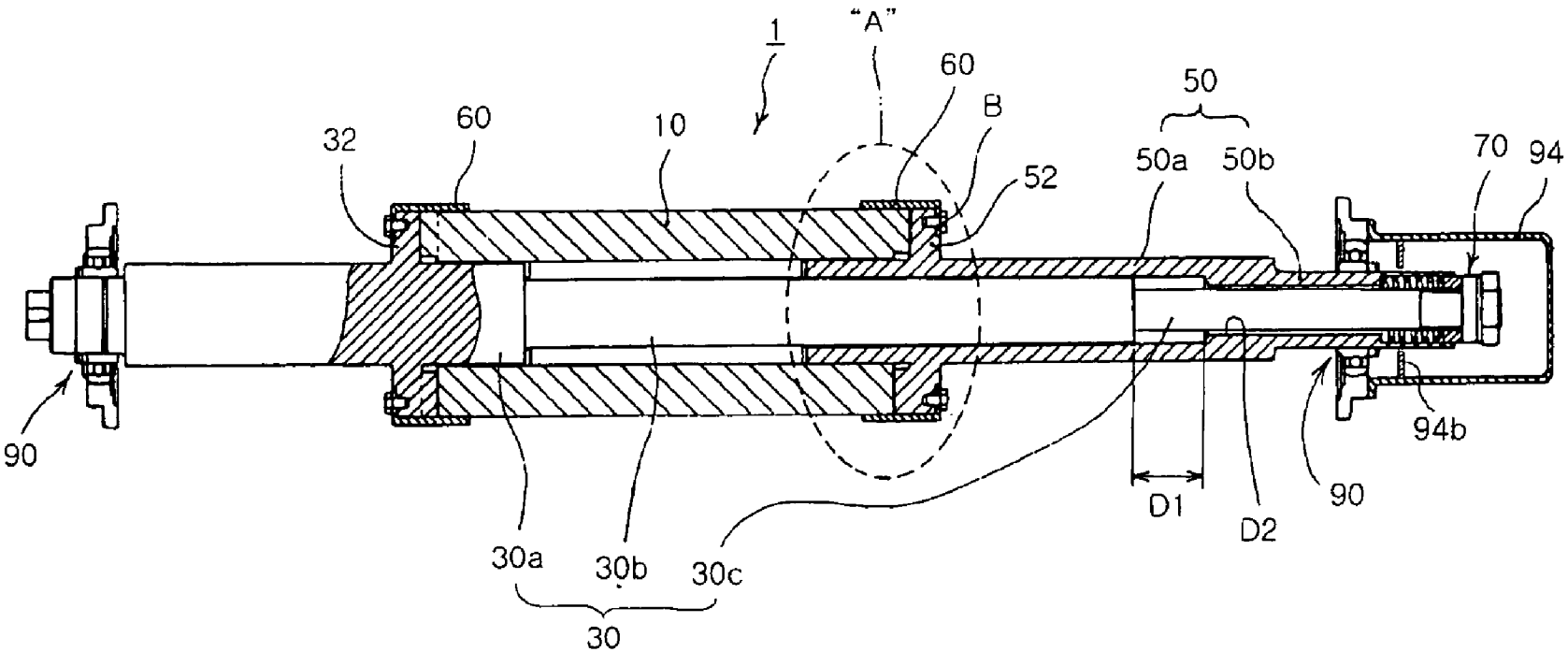

[Fig. 6]
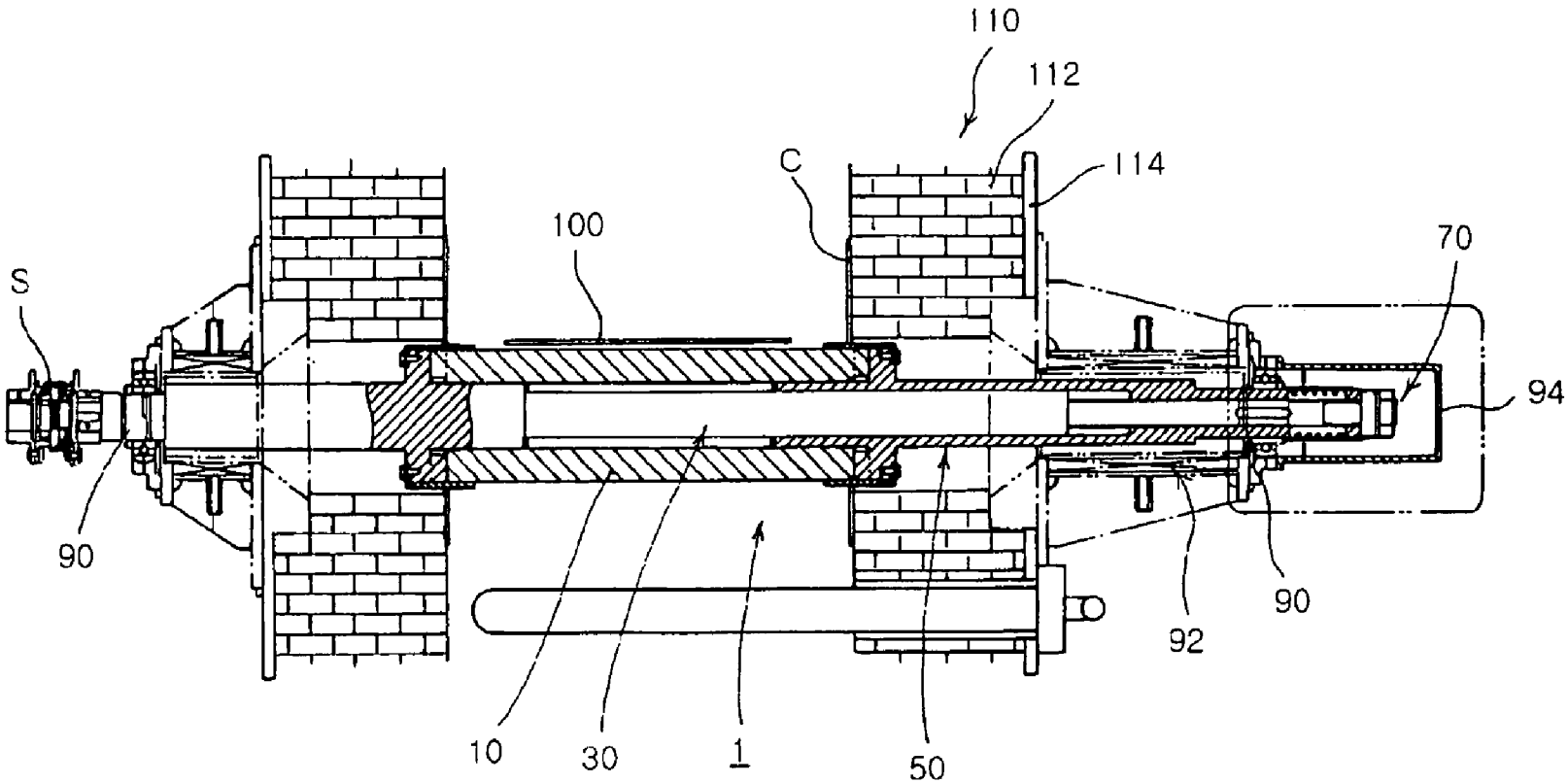

[Fig. 7]
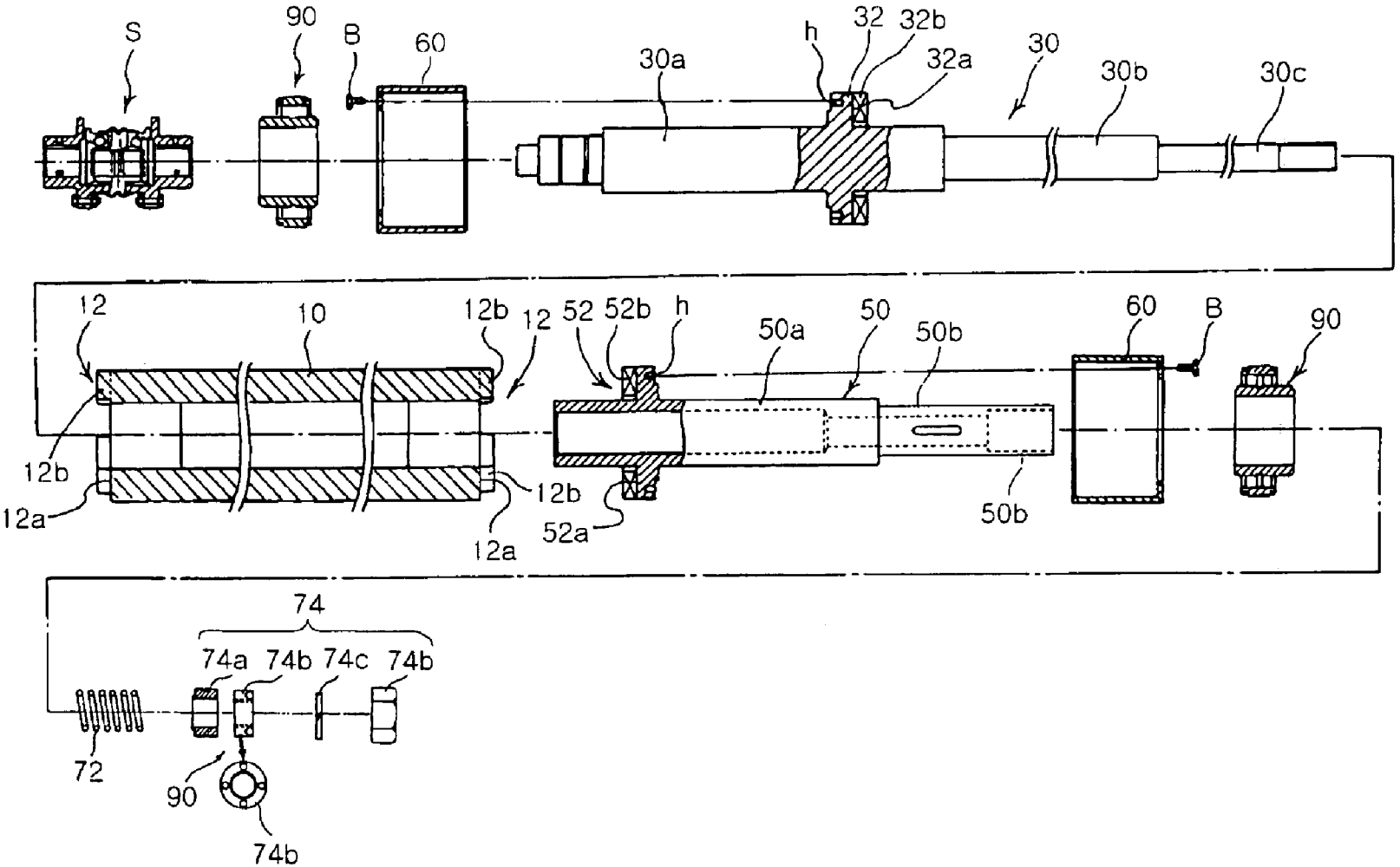

[Fig. 8]
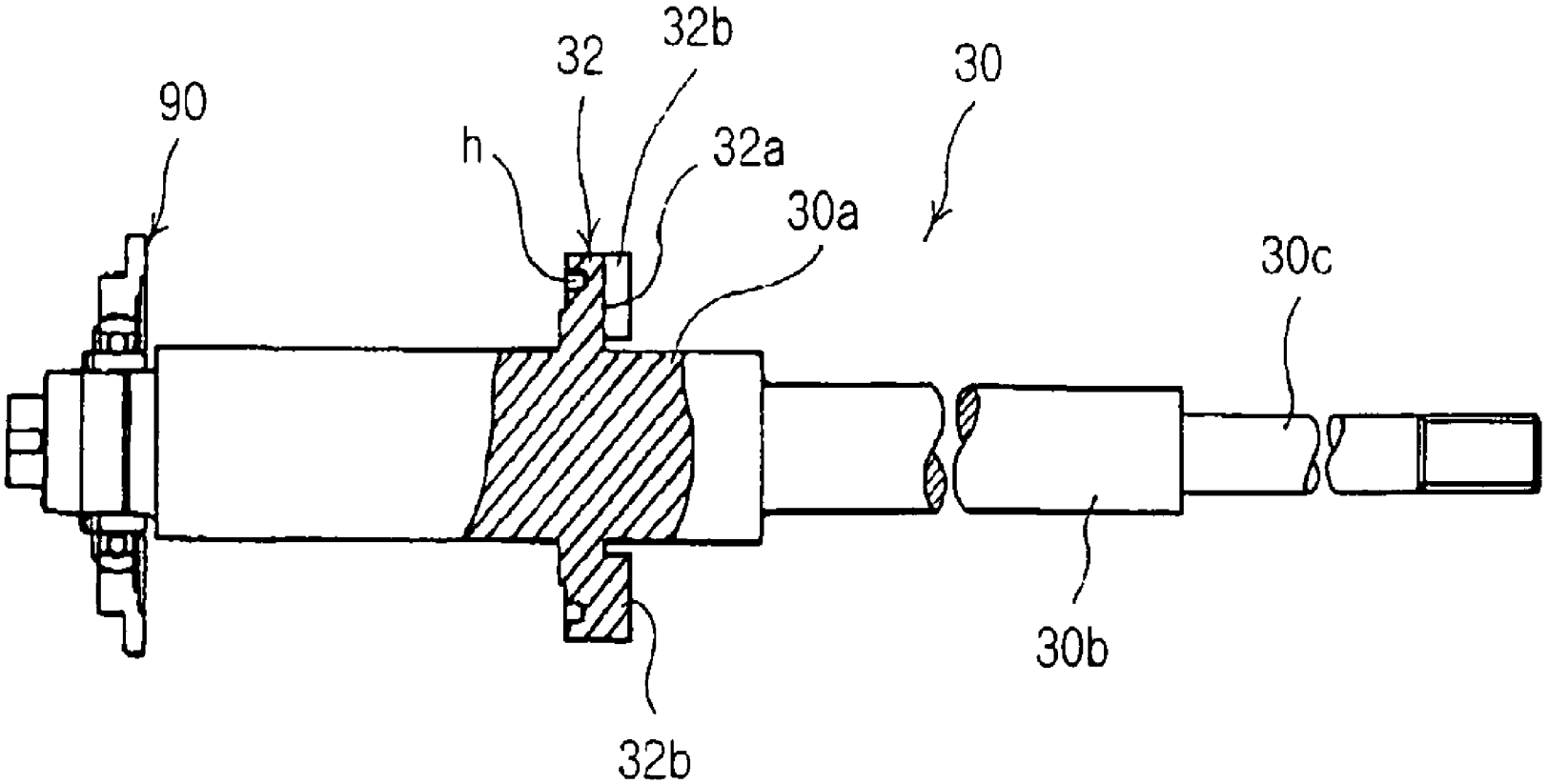

[Fig. 9]
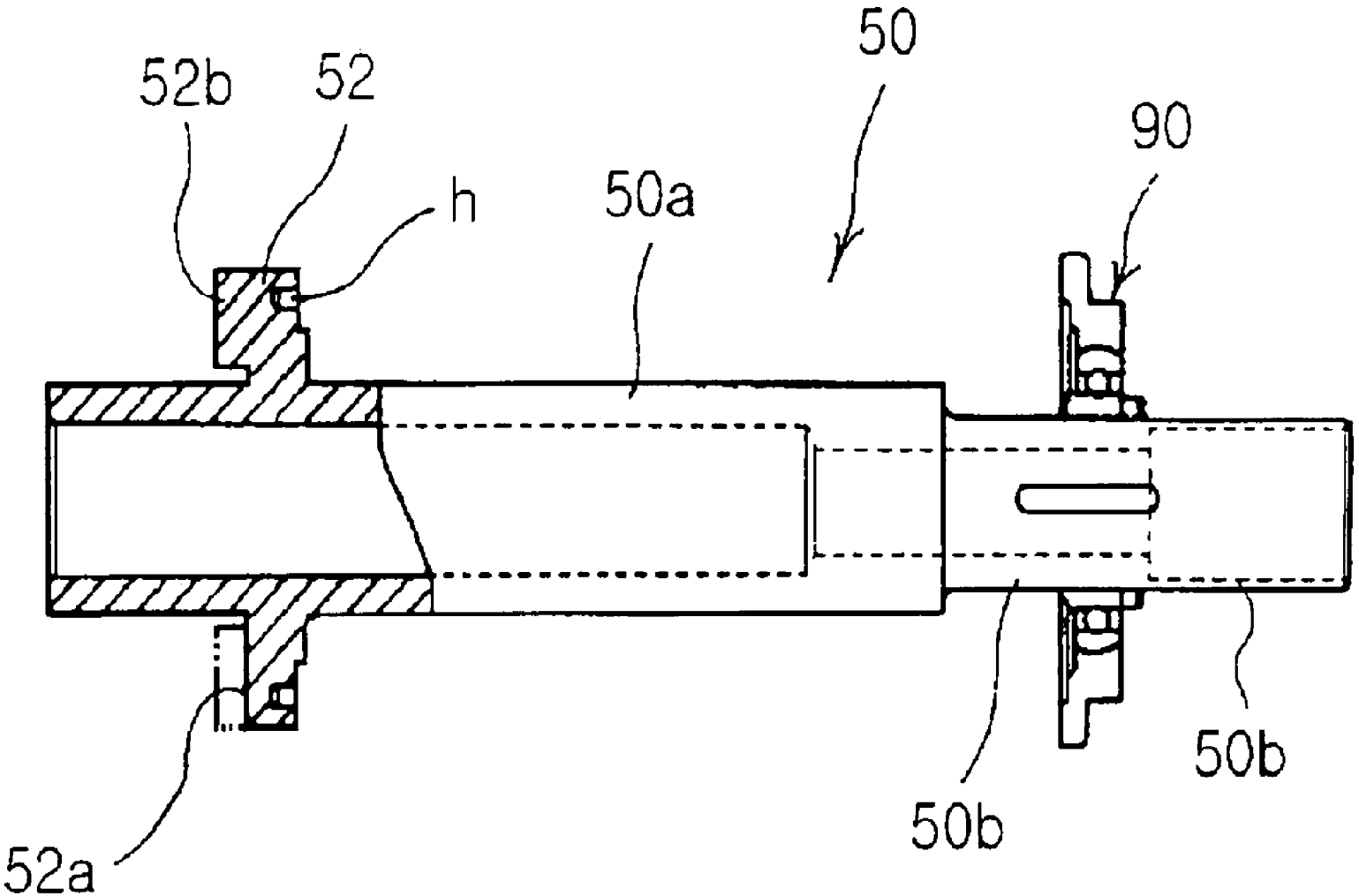

[Fig. 10]
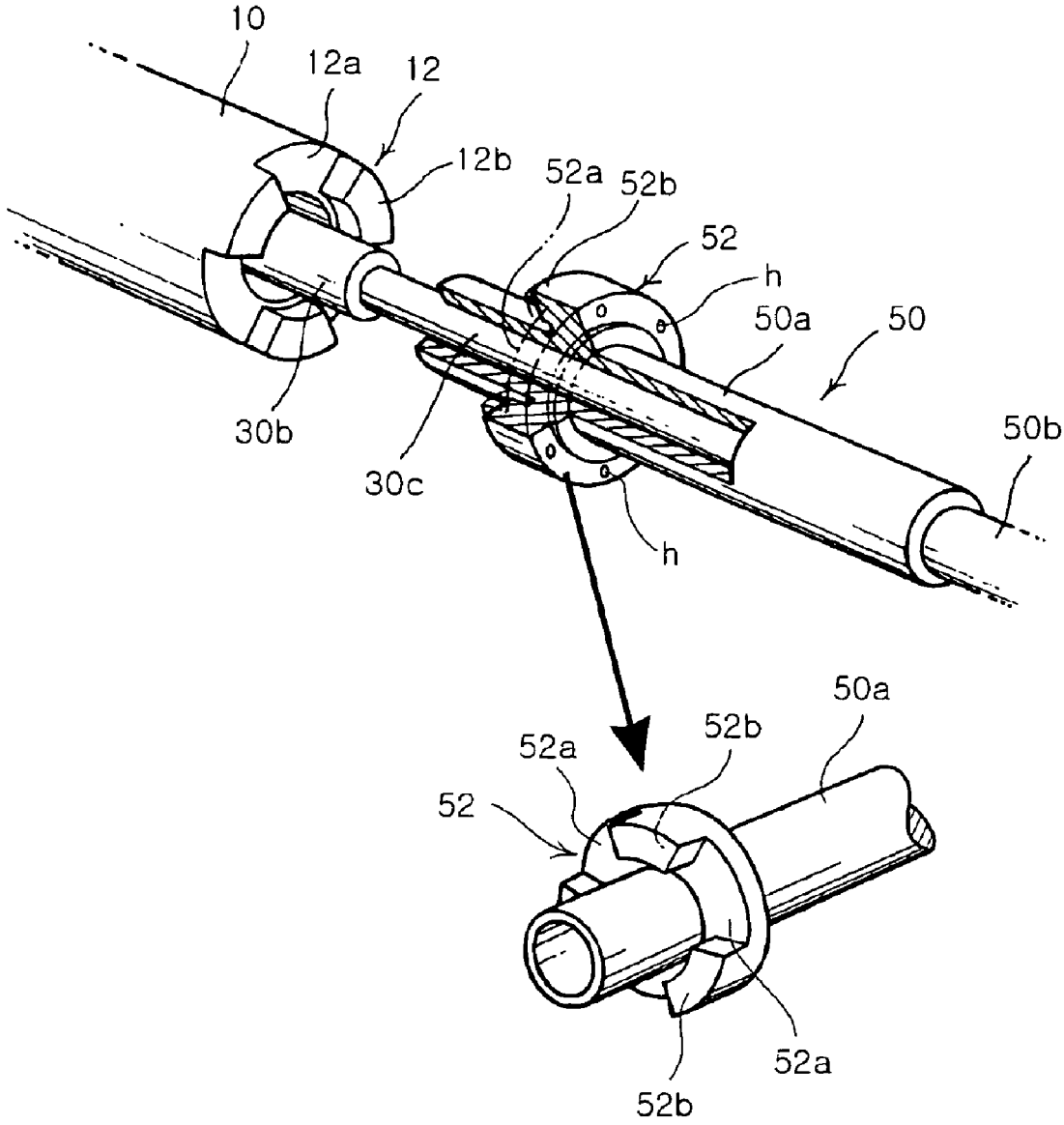

[Fig. 11]
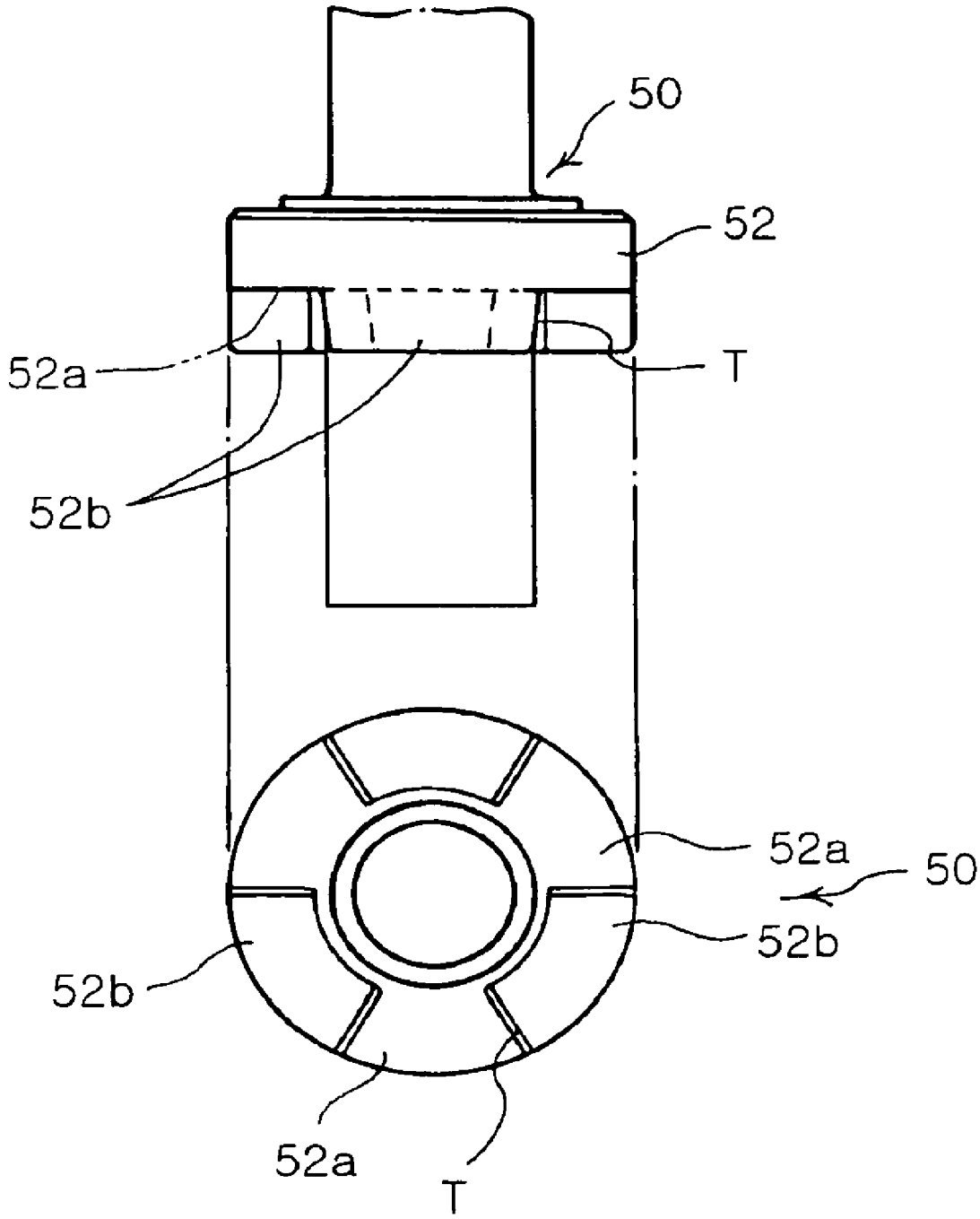

[Fig. 12]
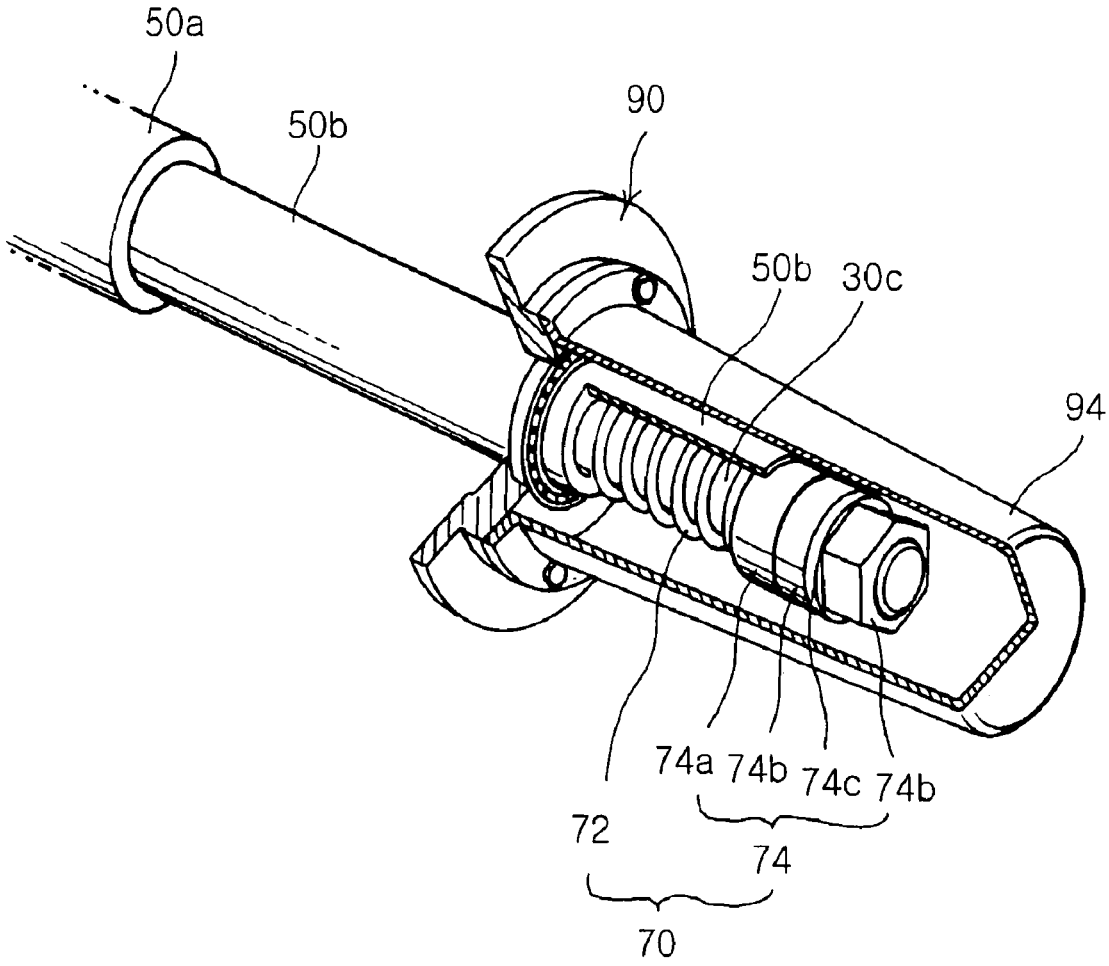

[Fig. 13]
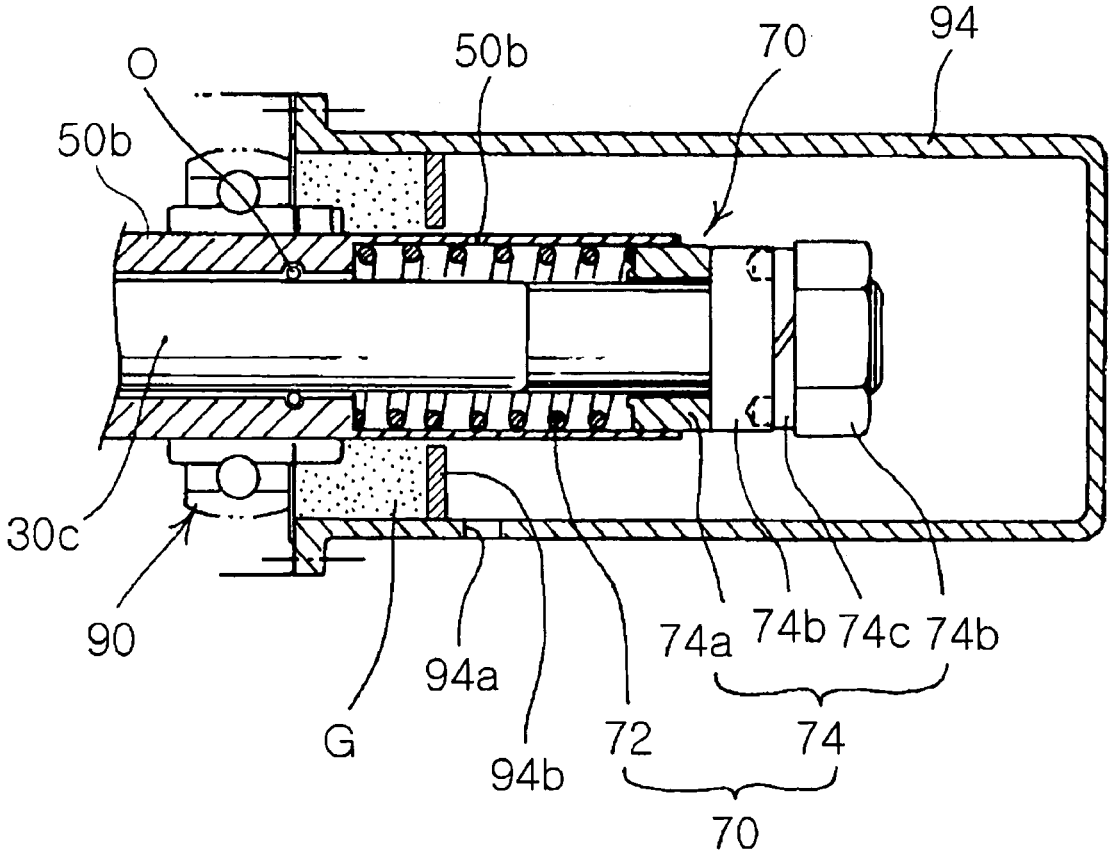

[Fig. 14]
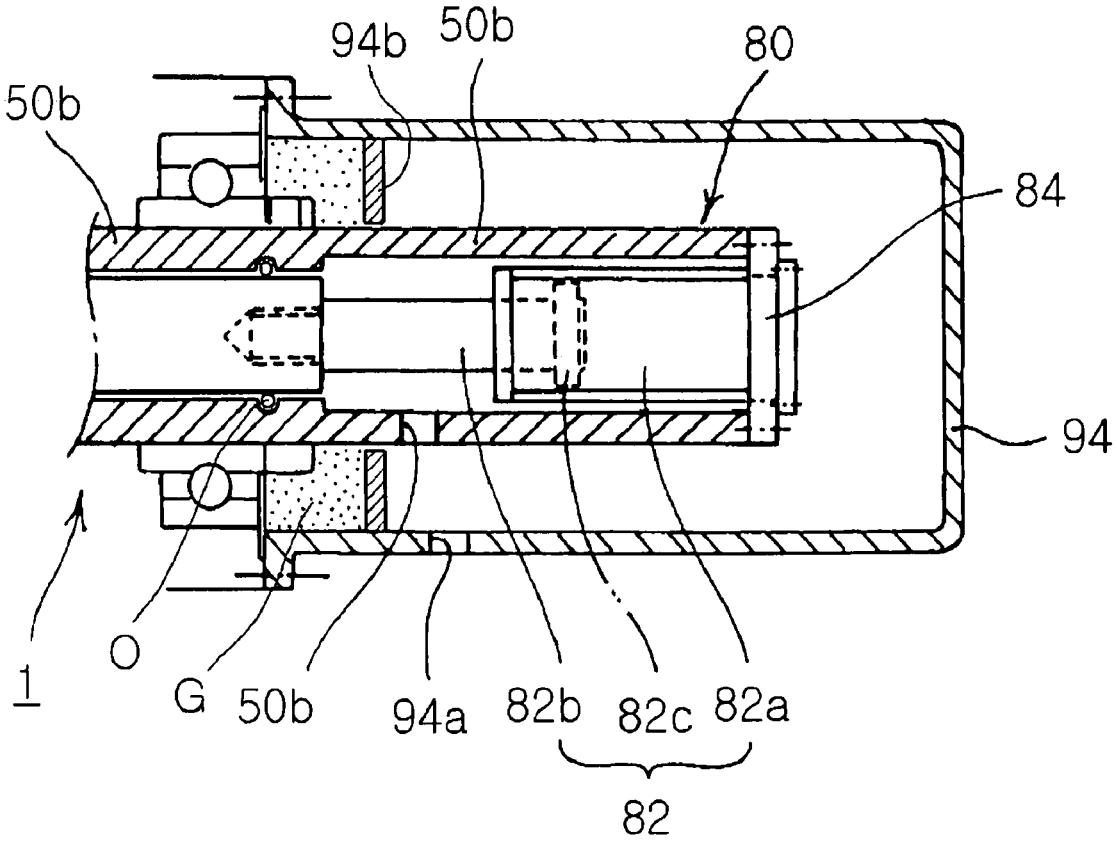

HEARTH ROLL APPARATUS FOR ANNEALING FURNACE

TECHNICAL FIELD

The present invention relates to a hearth roll apparatus which is used to feed a strip sheet in an annealing furnace for manufacturing a grain oriented or non-oriented electrical steel sheet.

More particularly, the present invention relates to a hearth roll apparatus for an annealing furnace which can minimize thermal deformation (e.g., creep) of a roll shaft by which the roll shaft is bent down in the annealing furnace of a high temperature, thereby improving operating performance of the hearth roll.

BACKGROUND ART

As shown in FIGS. 1 and 2, an annealing process of a strip sheet, which is manufactured by rolling mills in a hot rolling plant, a cold rolling plant or an electrical steel plant, is performed by releasing a strip sheet 100 from a pay off reel 120 mounted to an inlet of an annealing furnace 110 and winding the strip sheet 100, which has passed through the annealing furnace 110, around a tension reel 130 mounted to an outlet of the annealing furnace 110.

Hearth rolls 140 are provided to feed the strip sheet 100 having a constant tension in the annealing furnace 110 between the pay off reel and the tension reel.

For example, a grain oriented or non-oriented electrical steel sheet is produced by continuously feeding the strip sheet from the pay off reel to the tension reel and beat treating in the annealing furnace.

A reference numeral 112 in FIG. 1 is a wall of the annealing furnace, and a reference character C in FIG. 2 is an auxiliary heater coil which is arranged as shown in FIG. 2 on an inner surface of the annealing furnace wall (see FIG. 6) and heated by radiation.

FIG. 3 is a structure view showing a conventional hearth roll for the annealing furnace schematically depicted in FIGS. 1 and 2, and FIG. 4 is a partial sectional view showing a mounting state of a conventional hearth roll to the annealing furnace.

A conventional hearth roll 140 shown in FIG. 3 is disclosed in Korean Patent Laid-open Publication No. 2003-0054539. The hearth roll 140 is mounted in the annealing furnace 110 to feed the strip sheet 100 (see FIGS. 1 and 2).

The conventional hearth roll 140 includes a ceramic tube 142 having a good thermal resistance, a roll shaft 144 inserted through the ceramic tube 142, and tube fixing sleeves 146 coupled to both ends of the ceramic tube 142 to fix the roll shaft 144.

As shown in FIG. 3, the tube fixing sleeves 146 are fixed to the ceramic tube 142 by using first fixing pins 148*a*.

And, the tube fixing sleeves 146 are fixed to the roll shaft 144 by using second fixing pins 148*b*.

As shown in FIGS. 3 and 4, bearing blocks 148 are coupled to both end portions of the roll shaft 144 for rotation of the roll shaft.

As shown in FIG. 4, each of the bearing blocks 148 is mounted to a bracket fixed to an external steel frame 114 of the wall 112 of the annealing furnace, so that the roll shaft 144 can rotate by the bearing block.

A cover is coupled to an outer surface of the bearing block so as to surround the end of the roll shaft, and the cover is filled with grease G which is injected through an injecting pipe (not shown).

The grease G prevents external air from flowing into the annealing furnace in which hydrogen gas atmosphere is formed.

Such grease is also used in a hearth roll apparatus according to the present invention, which will be described later with reference to FIGS. 13 and 14.

A plurality of hearth rolls 140 pass through the wall 112 of the annealing furnace 110, and are driven individually. For example, as shown in FIG. 1, by a driving motor and a driving chain connected to the driving motor, the hearth rolls 140 rotate individually and feed the strip sheet 100.

As shown in FIGS. 1 and 3, a sprocket 150, which is engaged with the driving chain, is coupled to the end of the roll shaft of the hearth roll 140.

However, in the present, different from the structure of FIG. 1, driving motors are separately connected to the respective hearth rolls, so as to independently drive the hearth rolls.

For example, a coupling ring S (see FIG. 6, which will be described later), which is connected to a driving shaft (not shown) of the driving motor, may be connected to the roll shaft to independently drive the hearth rolls.

Because a temperature in the annealing furnace is kept to be high, about 1050° C., for the heat treatment of the strip sheet, the hearth roll 140 in the annealing furnace 110 is affected by heat.

In general, the roll shaft 144 of the hearth roll 140 is made from heat resistant steel (e.g., SCH 24), and the tube 142 is made from ceramic.

When the hearth roll is driven in the temperature of 1050° C. in the annealing furnace, a problem occurs because a coefficient of linear expansion of the roll shaft 144 made from heat resistant steel is different from that of the ceramic tube 142.

For example, the coefficient of linear expansion of the roll shaft 144 is about 30 times as large as that of the ceramic tube 142.

Accordingly, if comparing the roll shaft with the ceramic tube, because an elongation of the roll shaft is much larger than that of the ceramic tube, thermal deformation like creep is generated at the roll shaft 144 rather than the ceramic tube 142 in the high temperature.

The problem caused by the difference of the elongation of the ceramic tube 142 and the roll shaft 144 in the conventional hearth roll 140 is as follows.

For example, when the ceramic tube 142 has an outer diameter of 150 mm and an inner diameter of 75 mm and the roll shaft 144 made from heat resistant steel (e.g., SCH24) has an outer diameter of 74 mm, the elongation of the roll shaft 144 is measured to be about 5 times as large as that of the ceramic tube 142 in the temperature (about 1050° C.) of the annealing furnace.

In other words, the elongation of the roll shaft is larger than that of the tube made from ceramic which has a larger heat resistance than the heat resistant steel.

However, because of the difference of the elongation between the roll shaft and the ceramic tube in the conventional hearth roll 140, when the ceramic tube 142 and the tube fixing sleeves 146 are coupled to each other, gaps are generated at contacting portions (X and Y in FIG. 3), and coupling force between the components 142, 144 and 146 is loosened.

Especially, if heat in the annealing furnace is transferred to the roll shaft 144 through the gaps at the contacting portions (X and Y in FIG. 3) between the ceramic tube and the tube fixing sleeves, the roll shaft is subject to the thermal deformation (bending) like creep.

Thus, as illustrated by a dotted line at the roll shaft in FIG. 3, the center of the roll shaft 144, which is elongated more than the ceramic tube 142, hangs down.

If the center of the roll shaft hangs down, the load of the roll shaft is concentrated inward of an inner race of the bearing block 148 supporting the roll shaft 144. This hinders normal concentric rotation of the roll shaft 144.

Therefore, the conventional hearth roll 140 rotates eccentrically, and vibration is highly increased. When the conventional hearth roll is used for about 2 weeks to 2 months, the hearth roll malfunctions, and the strip sheet cannot be fed normally in the annealing furnace. Thus, the hearth roll should be replaced frequently.

Because the hearth roll 140 used in the annealing furnace is very expensive, when considering that about two hundred hearth rolls are necessary in the annealing furnace, the frequent replacement of the hearth roll 140 causes much costs for materials and labor.

Further, because the operation of the annealing furnace stops for a long time during the replacement of the hearth rolls, the normal production flow is cut, thereby deteriorating the productivity and the product quality.

On the other hand, in the real working field, in order to decrease the influence of the centrifugal force due to the deformation of the roll shaft on the strip sheet, for example, that the hung-down center of the roll shaft strikes the strip sheet when rotating and generates the defect on the surface of the strip sheet, the line speed in the annealing furnace is reduced.

For example, in case of the electrical steel sheet manufacturing process, even though the normal line speed in the annealing furnace is about 160 mpm, the line speed in real is reduced to about 120 mpm.

Accordingly, if a tensile force is forcedly applied to the roll shaft for stretching the roll shaft, the elongation of which is larger than that of the ceramic tube, because the hanging-down of the center of the roll shaft by the thermal effect is prevented, the operating performance of the hearth roll is improved, and the line speed of the strip sheet in the annealing furnace can be increased. Such an improvement of the hearth roll has been required.

Therefore, the present invention has been made in view of the above problems, and it is an object of the present invention to provide a hearth roll apparatus for an annealing furnace which can improve an operating performance by restraining thermal deformation (creep) by which a roll shaft of the hearth roll apparatus is bent down in an annealing furnace of a high temperature.

It is another object of the present invention to provide a hearth roll apparatus for an annealing furnace which can increase a rotating speed of a hearth roll, thereby increasing a line speed of a strip sheet and improving productivity.

SUMMARY OF THE INVENTION

In accordance with an aspect of the present invention, the above and other objects can be accomplished by the provision of a hearth roll apparatus for an annealing furnace comprising:

a ceramic tube which is provided inside the annealing furnace to contactingly feed a strip sheet;

a roll shaft which is coupled to a first end of the ceramic tube and extends across the annealing furnace through the ceramic tube;

a tube fixing sleeve which is coupled to a second end of the ceramic tube and through which a portion of the roll shaft is inserted; and a tension generating unit which interlocks with the roll shaft and the tube fixing sleeve and supplies a tensile force for stretching the roll shaft in a longitudinal direction.

Preferably, the ceramic tube is formed with first coupling portions at both the first end and the second end, the roll shaft is formed with a second coupling portion protruding around an outer peripheral surface to closely contact the first coupling portion formed at the first end of the ceramic tube, and the tube fixing sleeve is formed with a third coupling portion protruding around an outer peripheral surface to closely contact the first coupling portion formed at the second end of the ceramic tube.

More preferably, the first coupling portions formed at the first end and the second end of the ceramic tube include recessed portions and protruding portions which are formed alternately in a peripheral direction, and the second coupling portion of the roll shaft and the third coupling portion of the tube fixing sleeve include recessed portions and protruding portions which are closely engaged with the recessed portions and the protruding portions of the first coupling portions.

Preferably, the protruding portions of the first coupling portion, the second coupling portion and the third coupling portion protrude while being tapered oft from the recessed portions.

The hearth roll apparatus further comprises covers which surround a coupling area between the ceramic tube and the roll shaft and a coupling area between the ceramic tube and the tube fixing sleeve.

The roll shaft is formed with a first step portion, a second step portion stepped down from the first step portion in the longitudinal direction, and a third step portion stepped down from the second step portion in the longitudinal direction. The tube fixing sleeve is formed with a first step portion and a second step portion stepped down from the first step portion in the longitudinal direction, the second step portion of the roll shaft being disposed inside the first step portion of the tube fixing sleeve and the third step portion of the roll shaft being disposed inside the second step portion of the tube fixing sleeve.

Preferably, the first step portion of the roll shaft and the first step portion of the tube fixing sleeve are inserted into the ceramic tube by same lengths, a gap is formed between the second step portion of the roll shaft and the second step portion of the tube fixing sleeve, and a gap is formed between the third step portion of the roll shaft and an inner surface of the second step portion of the tube fixing sleeve.

A sealing member is mounted between the third step portion of the roll shaft and the second step portion of the tube fixing sleeve.

The tension generating unit includes an elastic member or a hydraulic/pneumatic part which interlocks with ends of the tube fixing sleeve and the roll shaft to apply the tensile force to the roll shaft.

Preferably, the elastic member is a coil spring, the coil spring having a front end supported by the second step portion of the tube fixing sleeve and a rear end supported by a fastening part which is coupled to the third step portion of the roll shaft passing through the coil spring. The coil spring stretches the roll shaft in the longitudinal direction by an elastic force, and pressurizes the tube fixing sleeve.

The fastening part includes a guide ring which is put around the third step portion of the roll shaft and at least one nut which is tightened to the third step portion of the roll shaft, and a protrusion extends integrally from the second step portion of the tube fixing sleeve to surround the elastic member and the guide ring.

Preferably, the hydraulic/pneumatic part includes a cylinder which is provided inside the tube fixing sleeve and horizontally mounted to a fixing plate coupled to a protrusion extending integrally from the second step portion of the tube fixing sleeve, and a piston rod which is provided inside the tube fixing sleeve and connected to the third step portion of the roll shaft. The protrusion is formed with a hole for discharging air or hydraulic oil leaked from the cylinder.

More preferably, the tension generating unit interlocking the tube fixing sleeve and the roll shaft is surrounded by a protective cover which sealingly contacts a bearing block connected to a wall of the annealing furnace. The protective cover is provided with a partition ring thereinside for storing grease with the bearing block to prevent inflow of external air into the annealing furnace, and formed with a hole for discharging the leaked grease, air or hydraulic oil.

Ends of the roll shaft and the tube fixing sleeve are supported by bearing blocks mounted to brackets fixed to a wall of the annealing furnace so that the roll shaft, the ceramic tube and the tube fixing sleeve can rotate.

According to a hearth roll apparatus for an annealing furnace of the present invention, although the roll shaft is elongated more than the ceramic tube in the annealing furnace of a high temperature, since the tension generating unit stretches the roll shaft in the longitudinal direction, thermal deformation like creep by which the roll shaft is bent down is minimized.

Also, because the coupling portions of the roll shaft, the ceramic tube and the tube fixing sleeve are closely coupled to each other and surrounded by the cover, a gap is not generated between the coupling portions. Although a gap is generated, the cover prevents heat from the annealing furnace from permeating to the roll shaft, thereby minimizing the thermal deformation of the roll shaft.

Also, because the line speed of the strip sheet in the annealing furnace can reach an optimal value, e.g., 160 mpm, the productivity is increased.

And, by restraining the thermal deformation of the roll shaft, life of the apparatus can be lengthened, costs for replacing the apparatus can be reduced, and product quality of the strip sheet can be increased.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view schematically showing a conventional annealing furnace of an electrical steel sheet manufacturing process;

FIG. 2 is a schematic view showing an annealing process of a strip sheet using an annealing furnace depicted in FIG. 1;

FIG. 3 is a structure view showing a conventional hearth roll for an annealing furnace;

FIG. 4 is a partial sectional view showing a mounting state of a hearth roll of FIG. 3 to an annealing furnace;

FIG. 5 is a structure view showing a hearth roll apparatus for an annealing furnace in accordance with the present invention;

FIG. 6 is a sectional view showing a mounting state of a hearth roll to an annealing furnace in accordance with the present invention:

FIG. 7 is an exploded view showing a hearth roll apparatus in accordance with the present invention;

FIG. 8 is a view showing a roll shaft of a hearth roll apparatus in accordance with the present invention;

FIG. 9 is a view showing a tube fixing sleeve of a hearth roll apparatus in accordance with the present invention;

FIG. 10 is an exploded perspective view of an "A" in FIG. 5;

FIG. 11 is a structure view showing a tube fixing sleeve depicted in FIG. 10;

FIG. 12 is a perspective view showing an embodiment of a tension generating unit of a hearth roll apparatus in accordance with the present invention;

FIG. 13 is a sectional view showing a tension generating unit depicted in FIG. 12; and FIG. 14 is a sectional view showing another embodiment of a tension generating unit of a hearth roll apparatus in accordance with the present invention.

BEST MODE FOR CARRYING OUT THE INVENTION

Now, preferred embodiments of the present invention will be described in detail with reference to the annexed drawings. In the following description, the same elements of a strip sheet 100 and an annealing furnace 110 as the prior art are denoted by the same reference numerals.

As shown in FIGS. 5 and 14, a hearth roll apparatus 1 of the present invention comprises a ceramic tube 10 which is provided inside an annealing furnace to contactingly feed a strip sheet, a roll shaft 30 which is coupled to a first end of the ceramic tube 10 and extends across the annealing furnace through the ceramic tube 10, a tube fixing sleeve 50 which is coupled to a second end of the ceramic tube 10 and through which a portion of the roll shaft 30 is inserted, and a first or second tension generating unit 70 or 80 which is provided at the tube fixing sleeve 50 and supplies a tensile force for stretching the roll shaft 30 in a longitudinal direction.

FIGS. 5 to 7 show the hearth roll apparatus 1 of the present invention, which includes the first tension generating unit 70.

As shown in FIGS. 5 to 7, in the hearth roll apparatus 1, the roll shaft 30 made from heat resistant steel (e.g., SCH 24) is coupled to the first end of the ceramic tube 10 which is exposed in the annealing furnace and has a good heat resistance, and the tube fixing sleeve 50 is coupled to the second end of the ceramic tube 10.

The roll shaft 30 is inserted through the tube fixing sleeve 50. The roll shaft 30 has a larger elongation and is deformed by heat more than the ceramic tube 10.

The first or second tension generating unit 70 (see FIG. 13) or 80 (see FIG. 14) is selectively coupled to an end of the tube fixing sleeve 50. The first or second tension generating unit 70 or 80 includes an elastic member 72 or a hydraulic/pneumatic part 82 which interlocks with a third step portion 30*c* of the roll shaft 30, so as to stretch the roll shaft 30 in the longitudinal direction by an elastic force or a hydraulic/pneumatic pressure.

Accordingly, although the roll shaft 30 is elongated more than the ceramic tube 10 when the hearth roll apparatus 1 is driven in the annealing furnace 110 of the temperature of 1050° C., since the first or second tension generating unit 70 or 80 stretches the roll shaft 30 in the longitudinal direction, thermal deformation like creep by which a center of the roll shaft 30 hangs down is minimized.

At this time, while stretching the roll shaft, the first or second tension generating unit 70 or 80 pressurizes the tube fixing sleeve 50 in the opposite direction to the stretching.

By pressurizing the tube fixing sleeve 50, first to third coupling portions of the ceramic tube 10, the roll shaft 30 and the tube fixing sleeve 50, which are essential components of the hearth roll apparatus 1, are in close contact with each other.

Therefore, as shown in FIG. 5, the first to third coupling portions of the ceramic tube 10, the roll shaft 30 and the tube fixing sleeve 50 can be securely assembled with each other as like a unitary body without screw coupling.

The hearth roll apparatus of the present invention which includes the first tension generating unit 70 will be described with reference to FIGS. 5 to 13, and the hearth roll apparatus which includes the second tension generating unit 80 will be described with reference to FIG. 14.

FIGS. 5 and 8 to 11 illustrate a coupling relation between the ceramic tube 10, the roll shaft 30 and the tube fixing sleeve 50 in the hearth roll apparatus 1 according to the present invention.

As shown in FIGS. 5 and 8, the roll shaft 30 is formed with first to third step portions 30*a*, 30*b* and 30*c* which are sequentially stepped down in the longitudinal direction from the first step portion 30*a* to the third step portion 30*c*.

As shown in FIGS. 5 and 9, the tube fixing sleeve 50 is formed with a first step portion 50*a* and a second step portion 50*b* stepped down from the first step portion 50*a* in the longitudinal direction. The roll shaft 30 is inserted through the tube fixing sleeve 50 in such a manner that the second step portion 30*b* of the roll shaft 30 is disposed inside the first step portion 50*a* and the third step portion 30*c* of the roll shaft 30 is disposed inside the second step portion 50*b*.

Accordingly, as shown in FIGS. 5 and 9, the ceramic tube 10 is formed in a hollow cylindrical shape which has a through-hole having a constant diameter. And, the first step portion 30*a* of the roll shaft 30 is inserted into the through-hole of the ceramic tube 10.

As shown in FIGS. 8 and 9, the roll shaft 30 is formed with a second coupling portion 32 protruding around an outer peripheral surface, to closely contact a first coupling portion 12 formed at the first end of the ceramic tube 10, and the tube fixing sleeve 50 is formed with a third coupling portion 52 protruding around an outer peripheral surface, to closely contact the first coupling portion 12 formed at the second end of the ceramic tube 10.

As shown in FIGS. 5 and 10, the first coupling portion 12 formed at the both ends of the ceramic tube 10 includes recessed portions 12*a* and protruding portions 12*b* which are formed alternately in the peripheral direction.

In the same manner, the second coupling portion 32 of the roll shaft 30 and the third coupling portion 52 of the tube fixing sleeve 50 are formed with recessed portions 32*a* and 52*a* and protruding portions 32*b* and 52*b* which are closely engaged with the recessed portions 12*a* and the protruding portions 12*b* of the first coupling portion 12.

Although FIG. 10 perspectively illustrates the recessed and protruding portions 12*a* and 12*b* of the first coupling portion 12 formed at the second end of the ceramic tube 10 and the recessed and protruding portions 52*a* and 52*b* of the third coupling portion 52 formed at the tube fixing sleeve 50, it will be understood that the recessed and protruding portions of the first coupling portion formed at the first end of the ceramic tube and the recessed and protruding portions 32*a* and 32*b* (see FIGS. 7 and 8) of the second coupling portion 32 formed at the roll shaft have the same shapes as illustrated in FIG. 10.

Therefore, as shown in FIGS. 5 and 10, the roll shaft 30, the ceramic tube 10 surrounding the roll shaft, and the tube fixing sleeve 50 for fixing the roll shaft and the ceramic tube are securely coupled to each other by the recessed portions and the protruding portions formed at the first to third coupling portions 12, 32 and 52 which are engaged with each other.

As shown in FIG. 11 (although FIG. 11 shows the tube fixing sleeve, it will be understood that the recessed portions and the protruding portions of the first and second coupling portions have the same shapes as illustrated in FIG. 11), the protruding portions protrude while being tapered off (T) from the recessed portions.

By the tapered protruding portions, the recessed portions and the protruding portions of the first to third coupling portions are closely and securely engaged with each other, and the coupling force is increased.

Further, the gaps are effectively prevented from being generated between the coupling portions of the ceramic tube and the roll shaft and between the coupling portions of the ceramic tube and the tube fixing sleeve.

As shown in FIGS. 7 and 8, the first step portion 30*a* having the largest diameter of the roll shaft 30 is inserted into the through-hole of the ceramic tube 10. The second step portion 30*b* stepped down to have the smaller diameter is inserted through the tube fixing sleeve 50. The third step portion 30*c* stepped down to have the smallest diameter interlocks with the first or second tension generating unit 70 (see FIG. 13) or 80 (see FIG. 14).

Also, as shown in FIGS. 7 and 9, the tube fixing sleeve 50 is formed with through-holes stepped from each other in the longitudinal direction. The second step portion 30*b* and the third step portion 30*c* of the roll shaft 30 are inserted into the through-hole of the tube fixing sleeve 50.

At this time, as shown in FIG. 5, the first step portion 30*a* of the roll shaft 30 and the first step portion 50*a* of the tube fixing sleeve 50 are inserted into the through-hole of the ceramic tube 10 by the same lengths.

Such a structure prevents the eccentric rotation of the ceramic tube, the roll shaft and the tube fixing sleeve.

As shown in FIG. 10, the recessed and protruding portions 12*a* and 12*b* of the first coupling portions 12 formed at both the first and the second ends of the ceramic tube 10 have the same shapes as each other. And, the recessed and protruding portions 32*a* and 32*b* of the second coupling portion 32 formed at the roll shaft 30 have the same shapes as the recessed and protruding portions 52*a* and 52*b* of the third coupling portion 52 formed at the tube fixing sleeve 50.

By the aforesaid structure, the roll shaft or the tube fixing sleeve can be coupled to either the first end or the second end of the ceramic tube. Accordingly, the assembly efficiency is increased.

As shown in FIG. 5, in consideration of the elongation of the roll shaft, a gap D1 is formed between the second step portion 30*b* of the roll shaft 30 and the second step portion 50*b* of the tube fixing sleeve 50.

A small gap D2 is formed between the third step portion 30*c* of the roll shaft 30 and the inner surface of the second step portion 50*b* of the tube fixing sleeve 50, so as to ensure the movement of the roll shaft.

As shown in FIGS. 5 and 6, if the roll shaft 30 expands by heat and is stretched by the tension generating unit 70 (see FIG. 13) or 80 (see FIG. 14), the roll shaft 30 moves in the tube fixing sleeve 50.

At this time, because the second step portion 30*b* of the roll shaft 30 is disposed inside the first step portion 50*a* of the tube fixing sleeve 50, the movability of the roll shaft is stably maintained.

In other words, as shown in FIG. 5, by the pressurizing force of the tension generating unit 70 (or 80 in FIG. 14) to the tube fixing sleeve 50, the roll shaft 30 can expand in the longitudinal direction through the tube fixing sleeve 50.

Accordingly, although the roll shaft 30 in the tube fixing sleeve 50 expands by heat. since the tensile force is applied to the roll shaft 30, the roll shaft 30 is not bent down and can perform the concentric rotation.

As a result, in the hearth roll apparatus 1 according to the present invention, even when the line speed of the strip sheet in the annealing furnace 110 reaches about 160 mpm, the above-described problem of the prior art does not happen.

As shown in FIGS. 5 and 7, covers 60 surround a coupling area between the first coupling portion of the ceramic tube 10 and the second coupling portion of the roll shaft 30 and a coupling area between the first coupling portion of the ceramic tube 10 and the third coupling portion of the tube fixing sleeve 50.

The cover 60, as shown in FIG. 7, has a hollow cylindrical shape. A first end of the cover 60 is opened, and a second end is formed with a hole at a center portion through which the roll shaft 30 or the tube fixing sleeve 50 passes. Preferably, the cover 60 is made from heat resisting material.

Therefore, the coupling area between the first coupling portion 12 of the ceramic tube 10 and the second coupling portion 32 of the roll shaft 30 and the coupling area between the first coupling portion 12 of the ceramic tube 10 and the third coupling portion 52 of the tube fixing sleeve 50 are covered by the covers 60 and protected.

Even when gaps are generated at the coupling areas of the ceramic tube 10, the roll shaft 30 and the tube fixing sleeve 50, the covers 60 prevent radiant heat from the annealing furnace from permeating to the roll shaft 30, and delays the heat transfer.

As shown in FIGS. 7 to 9, the covers 60 are fixed by tightening screws B into screw holes h formed at the second coupling portion 32 of the roll shaft 30 and the third coupling portion 52 of the tube fixing sleeve 50.

Of course, the length of the cover 60, as shown in FIG. 6, is adjusted appropriately so as to avoid the interference with the strip sheet to be fed.

And, as shown in FIGS. 5 and 7, bearing blocks 90 are coupled to the first step portion 30*a* of the roll shaft 30 and the second step portion 50*b* of the tube fixing sleeve 50.

The bearing block 90, as shown in FIG. 6, is fixed to a bracket 92 which is horizontally mounted to a steel frame 114 of a wall 112 of the annealing furnace.

As shown in FIGS. 6 and 7, a coupling S is coupled to an end of the first step portion of the roll shaft 30, to which a driving shaft of a driving motor is connected.

Accordingly, a plurality of hearth roll apparatuses 1 of the present invention which are installed across the annealing furnace, as shown in FIG. 6, can be independently rotated, and the strip sheet 100 is fed on the ceramic tube 10 while contacting the same.

A reference character C in FIG. 6 is an auxiliary heater coil which is arranged as shown in FIG. 2 on an inner surface of the annealing furnace wall 122 and heated by radiation. The auxiliary heater coil C keeps the temperature in the annealing furnace constant together with a main heating unit like a burner (see FIG. 2).

As described above, the hearth roll apparatus 1 selectively includes two types of the tension generating units 70 and 80. The first tension generating unit 70 has the spring-shaped elastic member 72 (see FIGS. 12 and 13), and the second tension generating unit 80 has the hydraulic/pneumatic part 82 (see FIG. 14).

Such a tension generating unit 70 or 80 interlocks with the third step portion 30*c* of the roll shaft 30 as well as the end of the second step portion 50*b* of the tube fixing sleeve 50.

Therefore, the tension generating unit 70 or 80 pressurizes the tube fixing sleeve 50 by the elastic force of the elastic member 72 or the hydraulic/pneumatic pressure of the hydraulic/pneumatic part 82. By pressurizing the tube fixing sleeve 50, the first to third coupling portions of the ceramic tube 10, the roll shaft 30 and the tube fixing sleeve 50 are in close contact with each other.

Especially, the tension generating unit 70 or 80 stretches the roll shaft 30, which has a relatively large elongation and is subject to the heat deformation, in the longitudinal direction, thereby preventing the center of the roll shaft 30 from hanging down by heat.

The elastic member 72 of the first tension generating unit 70, as shown in FIGS. 12 and 13, is a coil spring. The third step portion 30*c* of the roll shaft 30 passes through the coil spring, and a front end of the coil spring contacts the second step portion 50*b* of the tube fixing sleeve 50.

As shown in FIGS. 7 and 13, it is preferable to form a protrusion 50*b*' which extends integrally from the second step portion of the tube fixing sleeve.

As shown in FIGS. 12 and 13, the protrusion 50*b*' surrounds the elastic member 72 to stabilize the coupling state and operation of the elastic member 72 and prevent inflow of exterior material.

A rear end of the elastic member 72 is supported by a fastening part 74 which is coupled to the third step portion of the roll shaft passing through the coil spring.

Describing in detail, as shown in FIGS. 12 and 13, the fastening part 74 includes a guide ring 74*a* which is put around the third step portion 30*c* of the roll shaft, and at least one nut 74*b* which is tightened to a screw portion (not shown) formed at the third step portion 30*c* of the roll shaft.

If two or more nuts 74*b* are provided, a washer 74*c* may be interposed therebetween.

Accordingly, as shown in FIGS. 12 and 13, the guide ring 74*a*, the first nut 74*b*, the washer 74*c* and the second nut 74*b* are sequentially coupled to the screw portion (not shown) formed at the third step portion 30*c* of the roll shaft 30.

Also, as shown in FIGS. 13 and 14, a protective cover 94 is mounted to the bearing block 90 while surrounding the first or second tension generating unit 70 or 80 to protect the same from exterior material.

The protective cover 94, as shown in FIGS. 13 and 14, should sealingly contact the bearing block 90.

At this time, as shown in FIG. 13, it is preferable to mount a sealing member such as an o-ring O, a packing or the like around the inner peripheral surface near the end of the second step portion 50*b* of the tube fixing sleeve through which the third step portion 30*c* of the roll shaft is inserted.

Inside the protective cover 94, a partition ring 94*b* is provided around the protrusion 50*b*' of the tube fixing sleeve near the bearing block 90. The partition ring 94*b* is configured such that an outer periphery is in close contact with the inner peripheral surface of the protective cover 94 and an inner periphery is slightly spaced apart from (i.e., in non-contact with) the protrusion 50*b*' of the tube fixing sleeve.

As described above with reference to FIG. 4, grease G is filled in a space defined by the partition ring 94*b* and the bearing block by being injected through a supply pipe (not shown).

Accordingly, in the first tension generating unit 70 including the protective cover 94 and the elastic member 72, the sealing member like the o-ring O and the grease G prevent external air from flowing into the annealing furnace along the roll shaft.

As shown in FIG. 13, it is preferable to form a discharge hole 94*a* at the bottom of the protective cover 94 in order to discharge the melted grease G flowing out of the partition ring 94*b* during the operation of the annealing furnace.

As described above, FIG. 14 illustrates the second tension generating unit 80 which includes the hydraulic/pneumatic part 82.

Describing in detail, a fixing plate 84 is coupled to the end of the protrusion 50*b*' which extends integrally from the second step portion 50*b* of the tube fixing sleeve 50 beyond the third step portion 30*c* of the roll shaft 30.

The hydraulic/pneumatic pair 82 is provided inside the tube fixing sleeve, and horizontally installed to the fixing plate 84.

As shown in FIG. 14, the hydraulic/pneumatic part 82 includes a cylinder 82*a* fixed to the fixing plate 84, a piston 82*c* movably inserted in the cylinder 82*a*, and a piston rod 82*b* connected to the piston 82*c* to move forward and backward together with the piston 82*c*.

The piston rod 82*b* is connected to the third step portion 30*c* of the roll shaft 30.

Accordingly, in the second tension generating unit 80, the roll shaft 30 is stretched in the longitudinal direction by the piston rod 82*b* and the piston 82*a*, the movement of which is controlled by the hydraulic or pneumatic pressure in the cylinder 82*a*, thereby preventing the center of the roll shaft from hanging down when the roll shaft expands by heat. In other words, the roll shaft extends axially by the tensile force applied thereto.

If the piston rod 82*b* of the hydraulic/pneumatic part 82 moves backward to stretch the roll shaft, the tube fixing sleeve 50, to which the fixing plate is fixed, is pressurized toward the ceramic tube and the roll shaft, and so the coupling portions of the ceramic tube, roll shaft and the sleeve are kept in a close contact state.

In order to prevent air or hydraulic oil leaked from the cylinder 82*a* from flowing into the roll shaft, a hole 50*b*" is formed at the bottom of the protrusion 50*b*' which extends integrally from the second step portion of the tube fixing sleeve 50. Thus, the air or hydraulic oil leaked from the cylinder 82*a* is discharged outside through the hole 50*b*".

Similarly to the first tension generating unit 70 depicted in FIG. 13, the second tension generating unit 80 is provided with an o-ring O around the inner peripheral surface near the end of the second step portion 50*b* of the tube fixing sleeve through which the third step portion 30*c* of the roll shaft is inserted. The o-ring prevents inflow of air into a gap between the roll shaft and the sleeve.

Inside the protective cover 94, a partition ring 94*b* is provided near the bearing block 90, and grease G is filled in a space defined by the partition ring and the bearing block, so as to prevent inflow of external air.

In the same manner as illustrated in FIG. 13, in the second tension generating unit, it is preferable to form a discharge hole 94*a* at the bottom of the protective cover 94 in order to discharge the grease G flowing out of the partition ring 94*b*.

Hereinafter, an assembling process of the hearth roll apparatus 1 according to the present invention, which includes the first tension generating unit 70, will now be described.

First, as shown in FIGS. 5 and 7, the second coupling portion 32 of the roll shaft 30 is forcedly fitted into the cover 60, and the cover 60 is fixed by tightening the screws B into the screw holes h formed at the second coupling portion of the roll shaft.

In state of fixing the roll shaft 30 by a jig, the ceramic tube 10 is assembled with the roll shaft 30 in such a manner that the recessed portions 12*a* and the protruding portions 12*b* of the first coupling portion 12 formed at the first end of the ceramic tube 10 are tightly engaged with the recessed portions 32*a* and the protruding portions 32*b* of the second coupling portion 32 formed at the roll shaft 30.

The third coupling portion 52 of the tube fixing sleeve 50 is forcedly fitted into the other cover 60, and the cover 60 is fixed by tightening the screws B into the screw holes formed at the third coupling portion of the tube fixing sleeve.

In state of fixing the ceramic tube 10 with the roll shaft 30 by the jig, the tube fixing sleeve 50 is assembled with the ceramic tube 10 in such a manner that the recessed portions 52*a* and the protruding portions 52*b* of the third coupling portion 52 formed at the tube fixing sleeve 50 are tightly engaged with the recessed portions 12*a* and the protruding portions 12*b* of the first coupling portion 12 formed at the second end of the ceramic tube 10.

As shown in FIGS. 7 and 13, the bearing blocks 90, the coupling S and the tension generating unit 70 are assembled to the ends of the roll shaft 30 and the tube fixing sleeve 50.

As shown in FIGS. 7, 12 and 13, the tension generating unit 70 is assembled by putting the elastic member 72 and the guide ring 74*a* around the third step portion 30*c* of the roll shaft 30.

Then, the pair of the nuts 74*b* and the washer 74*c* interposed therebetween are coupled to the screw portion formed around the third step portion 30*c* of the roll shaft.

By this structure, the tension generating unit 70 pressurizes the tube fixing sleeve in the axial direction by the elastic force of the elastic member 72, and simultaneously applies the tensile force to the roll shaft 30 to stretch the roll shaft 30 in the longitudinal direction.

Conclusively, the hearth roll apparatus I according to the present invention can restrain the bending-down of the roll shaft due to heat, the elongation of which is larger than that of the ceramic tube, by stretching the roll shaft.

In consideration of the thermal deformation of the roll shaft 30 in the longitudinal direction and the proper coupling force (including a safety factor), it is required to select the elastic member 72 having a proper elastic force or adjust the tightening force of the nuts to the roll shaft appropriately.

Similarly to the first tension generating unit 70 including the elastic member 72 (see FIG. 13), the second tension generating unit 80 illustrated in FIG. 14, which includes the hydraulic/pneumatic part 82, can restrain the bending-down of the roll shaft 30 due to heat by stretching the roll shaft 30 in the longitudinal direction according to the moving distance of the piston rod.

As apparent from the above description, the hearth roll apparatus for the annealing furnace of the present invention can restrain the thermal deformation of the roll shaft, thereby lengthening life of the apparatus, reducing costs for replacing the apparatus, and increasing product quality of the strip sheet.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A hearth roll apparatus for an annealing furnace comprising:

a ceramic tube which is provided inside the annealing furnace to contactingly feed a strip sheet;

a roll shaft which is coupled to a first end of the ceramic tube and extends across the annealing furnace through the ceramic tube;

a tube fixing sleeve which is coupled to a second end of the ceramic tube and through which a portion of the roll shaft is inserted; and a tension generating unit which interlocks with the roll shaft and the tube fixing sleeve and supplies a tensile force for stretching the roll shaft in a longitudinal direction, wherein the roll shaft is formed with multiple step portions in the longitudinal direction and the tube fixing sleeve is formed with multiple step portions in the longitudinal direction, the multiple step portions of the roll shaft being disposed inside thereof.

2. The hearth roll apparatus according to claim 1, wherein ends of the roll shaft and the tube fixing sleeve are supported by bearing blocks mounted to brackets fixed to a wall of the annealing furnace so that the roll shaft, the ceramic tube and the tube fixing sleeve can rotate.

3. The hearth roll apparatus according to claim 1, wherein the ceramic tube is formed with first coupling portions at both the first end and the second end, the roll shaft is formed with a second coupling portion protruding around an outer peripheral surface to closely contact the first coupling portion formed at the first end of the ceramic tube, and the tube fixing sleeve is formed with a third coupling portion protruding around an outer peripheral surface to closely contact the first coupling portion formed at the second end of the ceramic tube.

4. The hearth roll apparatus according to claim 3, wherein the first coupling portions formed at the first end and the second end of the ceramic tube include recessed portions and protruding portions which are formed alternately in a peripheral direction, and the second coupling portion of the roll shaft and the third coupling portion of the tube fixing sleeve include recessed portions and protruding portions which are closely engaged with the recessed portions and the protruding portions of the first coupling portions.

5. The hearth roll apparatus according to claim 4, wherein the protruding portions of the first coupling portion, the second coupling portion and the third coupling portion protrude while being tapered off from the recessed portions.

6. The hearth roll apparatus according to claim 4, wherein the apparatus further comprises covers which surround a coupling area between the ceramic tube and the roll shaft and a coupling area between the ceramic tube and the tube fixing sleeve.

7. The hearth roll apparatus according to claim 1, wherein the multiple step portions of the roll shaft include a first step portion, a second step portion stepped down from the first step portion in the longitudinal direction, and a third step portion stepped down from the second step portion in the longitudinal direction, and the multiple step portions of the tube fixing sleeve include a first step portion and a second step portion stepped down from the first step portion in the longitudinal direction, the second step portion of the roll shaft being disposed inside the first step portion of the tube fixing sleeve and the third step portion of the roll shaft being disposed inside the second step portion of the tube fixing sleeve.

8. The hearth roll apparatus according to claim 7, wherein the first step portion of the roll shaft and the first step portion of the tube fixing sleeve are inserted into the ceramic tube by same lengths, a gap is formed between the second step portion of the roll shaft and the second step portion of the tube fixing sleeve, and a gap is formed between the third step portion of the roll shaft and an inner surface of the second step portion of the tube fixing sleeve.

9. The hearth roll apparatus according to claim 7, wherein a sealing member is mounted between the third step portion of the roll shaft and the second step portion of the tube fixing sleeve.

10. The hearth roll apparatus according to claim 7, wherein the tension generating unit includes an elastic member or a hydraulic/pneumatic part which interlocks with ends of the tube fixing sleeve and the roll shaft to apply the tensile force to the roll shaft.

11. The hearth roll apparatus according to claim 10, wherein the elastic member is a coil spring, the coil spring having a front end supported by the second step portion of the tube fixing sleeve and a rear end supported by a fastening part which is coupled to the third step portion of the roll shaft passing through the coil spring, whereby the coil spring stretches the roll shaft in the longitudinal direction by an elastic force, and pressurizes the tube fixing sleeve.

12. The hearth roll apparatus according to claim 11, wherein the fastening part includes a guide ring which is put around the third step portion of the roll shaft and at least one nut which is tightened to the third step portion of the roll shaft, and a protrusion extends integrally from the second step portion of the tube fixing sleeve to surround the elastic member and the guide ring.

13. The hearth roll apparatus according to claim 10, wherein the hydraulic/pneumatic part includes a cylinder which is provided inside the tube fixing sleeve and horizontally mounted to a fixing plate coupled to a protrusion extending integrally from the second step portion of the tube fixing sleeve, and a piston rod which is provided inside the tube fixing sleeve and connected to the third step portion of the roll shaft, and wherein the protrusion is formed with a hole for discharging air or hydraulic oil leaked from the cylinder.

14. The hearth roll apparatus according to claim 10, wherein the tension generating unit interlocking the tube fixing sleeve and the roll shaft is surrounded by a protective cover which sealingly contacts a bearing block connected to a wall of the annealing furnace, and wherein the protective cover is provided with a partition ring thereinside for storing grease with the bearing block to prevent inflow of external air into the annealing furnace, and formed with a hole for discharging leaked grease, air or hydraulic oil.

* * * * *